US006980118B2

(12) United States Patent
Buvac

(10) Patent No.: US 6,980,118 B2
(45) Date of Patent: Dec. 27, 2005

(54) METHOD AND APPARATUS FOR MEASURING STROKE RATING IN ROWING

(75) Inventor: Vanja Buvac, Cambridge, MA (US)

(73) Assignee: Vanja Buvac, Inc., Philadelphia, PA (US)

( * ) Notice: Subject to any disclaimer, the term of this patent is extended or adjusted under 35 U.S.C. 154(b) by 160 days.

(21) Appl. No.: 10/249,609

(22) Filed: Apr. 23, 2003

(65) Prior Publication Data

US 2003/0200802 A1 Oct. 30, 2003

Related U.S. Application Data

(60) Provisional application No. 60/374,983, filed on Apr. 24, 2002.

(51) Int. Cl.[7] ..... G08B 21/00

(52) U.S. Cl. ..... 340/689; 434/373; 434/247; 440/101; 482/72; 482/73

(58) Field of Search ..... 340/689, 545.5; 440/101, 102, 104, 105, 106; 482/72, 73, 111; 434/60, 219, 247, 373, 392, 255, 256; 73/379.01

(56) References Cited

U.S. PATENT DOCUMENTS

| | | | | | |
|---|---|---|---|---|---|
| 4,735,410 | A | * | 4/1988 | Nobuta | 272/72 |
| 4,832,332 | A | * | 5/1989 | Dumbser | 272/72 |
| 4,984,986 | A | * | 1/1991 | Vohnout | 272/72 |
| 5,099,689 | A | * | 3/1992 | McGinn | 73/379 |

* cited by examiner

*Primary Examiner*—Davetta W. Goins
(74) *Attorney, Agent, or Firm*—Jeffrey Furr

(57) ABSTRACT

The present invention detects the squaring and feathering of an oar during rowing. The time interval between two consecutive feathers is measured, and it is used to calculate the stroke rating. It is mounted to an oar close to the grip of the oar. An enclosure houses a display, a sensor, a microcontroller, a power source and a clock which is a component of the microcontroller. The stroke rating is displayed on a display. A strap is attached to the enclosure. The strap fastens the enclosure to the oar. The direction of the rotation of the oar from the squared position to the feathered position is shown by the arrow. Because of its small size, the device does not hinder rowing while remaining in plain view of the rower, and because it does not use any external or rigidly mounted sensors it can easily be transported and used on various equipment.

14 Claims, 5 Drawing Sheets

METHOD AND APPARATUS FOR MEASURING STROKE RATING IN ROWING

CROSS REFERENCE TO RELATED APPLICATIONS

This patent claims a priority date of Provisional Patent 60/374983 dated Apr. 24, 2002.

COPYRIGHT STATEMENT

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyright rights whatsoever.

BACKGROUND OF INVENTION

This invention relates generally to a digital indicating instrument for physical training and more particularly those used to measure and display the stroke rating in rowing.

1. Background

There exists a limited number of devices that can be used to measure and display the stroke rating in rowing.

A stop-watch can be used as the indicating instrument, operable for example by start and stop buttons. This would have the disadvantage, however, that the stop-watch has to be operated continuously during the training and stokes have to be manually counted in order to calculate the stroke rating.

2. Description of Prior Art

There have been various types of indicating instruments for rowing over the years.

U.S. Pat. No. 4,832,332 by Dumbser and issued on May 23, 1989, is for a "Digital indicating instrument for a physical training device." It discloses a digital indicating instrument for a physical training device, in particular a rowing device, includes a sensor fixed rigidly to a basic frame of the training device and sensor trip element fixed to an operating part, in particular to a sliding seat of the rowing device. An evaluation circuit responds to control pulses generated by the sensor during the passing movement of the trip element and determines together with the training time output-related data, which are displayed on a display screen. A training time measuring device is started by control pulses of the sensor for an automatic determination of the training time. Because the sensor for this device is fixed rigidly to the frame of the device it can't be easily transported to other equipment.

U.S. Pat. No. 4,984,986 by Vohnout and issued on Jan. 15, 1991, is for an "Apparatus and method for training oarsmen." It discloses a pair boat simulator including a housing which is mounted about a longitudinal roll axis upon supports above a training facility floor. Instrumentation includes transducers looking to inclinations of the housing about the roll or longitudinal axis, oar elevation and sweep angle as well as blade rotation. These parameters are combined and developed under computer driven control into data presented at visual readouts made available both to the oarsman and the coach. Such readouts include, for example, force versus sweep angle graphs, animated displays of heading, lateral position and hull velocity; values of effective power, and rowing efficiency. This device is intended to be used for off water training, and it can not be easily installed in a boat.

U.S. Pat. No. 4,396,904 by Hanaoka and issued on Aug. 2, 1983, is for an "Electronic pace timing device." It discloses an electronic pace timing device whereby a physically perceptible pace timing signal can be repetitively generated and whereby the repetition frequency of this pace timing signal can be set into the pace timing device as a numeric value by actuation of external operating members. No calculations are performed in order to convert the numeric value specifying the repetition frequency of the pace timing signal into an actual pace timing signal so that the overall circuit configuration can be very simple. This device is not specifically designed for use for rowing and rowing movements.

U.S. Pat. No. 4,309,599 by Myers is for a "Pacer Device." This device is limited to measuring arm or leg movements and only warning when a high or low threshold has been breached. Germany patent number 287,518 is for "A new Improved device for indicating and recording the energy expenditure of an oarsman during boat-rowing" and was issued in Mar. 23, 1927.

For the foregoing reasons, there is a need for a device that can easily be used to measure and display the stroke rating in rowing.

SUMMARY OF INVENTION

The present invention is a digital indicating device that detects the squaring and feathering of the oar. The time interval between two consecutive feathers is measured, and it is used to calculate the stroke rating. The device is mounted to an oar close to the grip of an oar. An enclosure houses a display, a sensor, a microcontroller with an internal clock, and a power source. The stroke rating is displayed on a display. A strap is attached to an enclosure. The strap fastens the enclosure to the oar. Because of its small size, it does not hinder rowing while remaining in plain view of the rower, and because it does not use any external or rigidly mounted sensors it can easily be transported and used on various equipment.

Accordingly, it is an object of the present invention to provide a digital indicating device that does not exhibit the disadvantages, inconveniences or potential pitfalls from use of the prior art devices previously described. It is another object of the present invention to provide a digital indicating device that is easy to use and carry. It is a further object of the present invention to provide a digital indicating device that does not hinder rowing while remaining in plain view of the rower.

It is a further object of the present invention to allow this device to be easily installed and removed so that it can be used on different rowing equipment.

These, together with other objects of this invention, along with various features of novelty which characterize this invention, are pointed out with particularity in the claims annexed hereto and forming a part of this disclosure. For a better understanding of this invention, its operating advantages and the specific objects attained by its uses, reference should be had to the accompanying drawings and descriptive matter in which there is illustrated a preferred embodiment.

BRIEF DESCRIPTION OF DRAWINGS

Without restricting the full scope of this invention, the preferred form of this invention is illustrated in the following drawings.

DETAILED DESCRIPTION

The following description of a digital indicating device is demonstrative in nature and is not intended to limit the scope of the invention or its application of uses.

Figure 1:
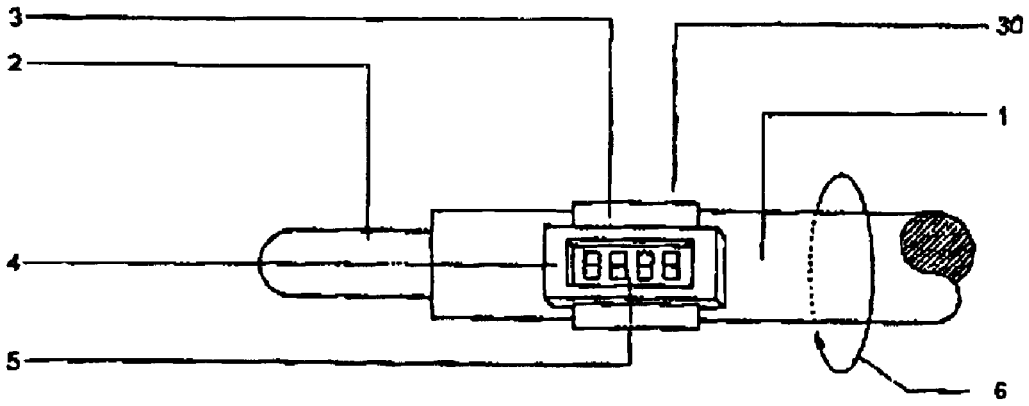
FIG. 1 shows an embodiment of the device fastened to an oar.
Figure 4:
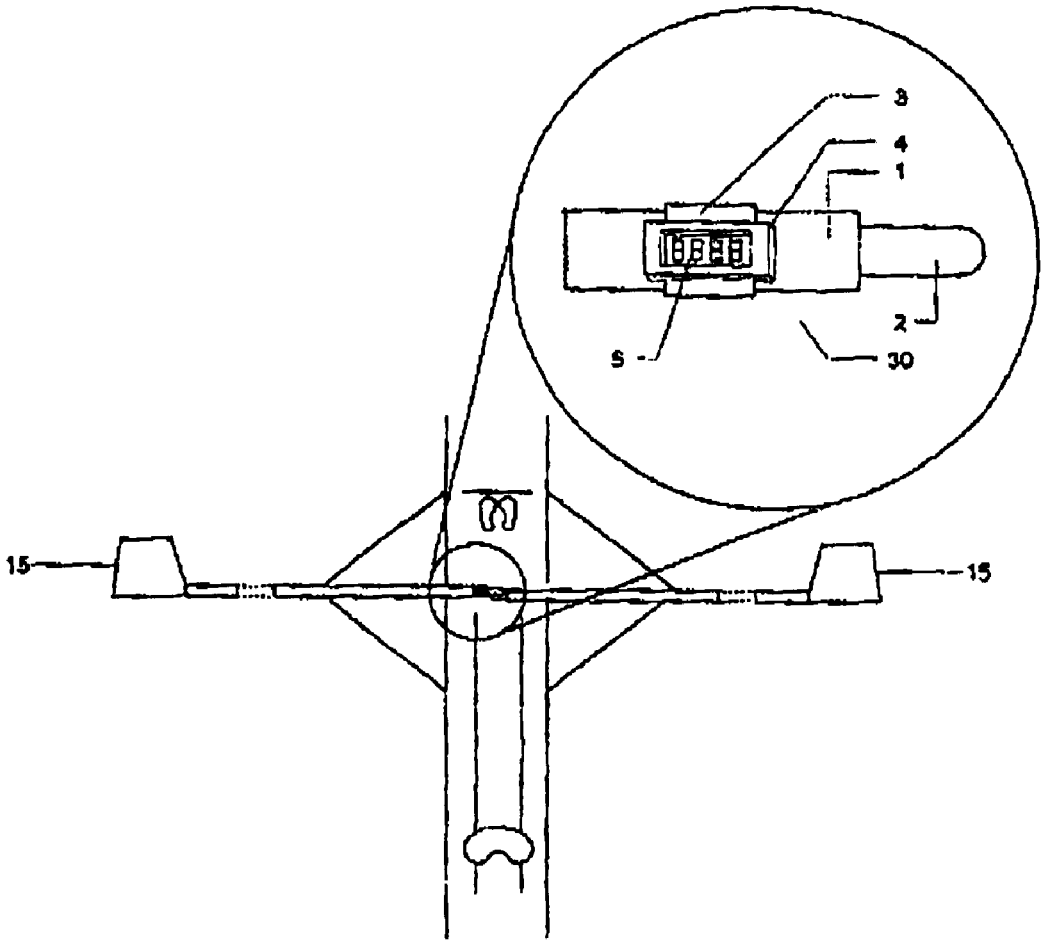
FIG. 4 shows the device should be mounted to an oar from a view that shows the boat with the oars from above.

The current invention exploits the mechanics of the oar motion to measure and display the stroke rating in rowing. Stroke rating is the frequency at which strokes are taken during rowing; it is commonly expressed in strokes per minute. The mechanics of rowing usually requires a rotation of the oar about its long axis during the stroke cycle. Here is a brief description of this mechanics. The two parts of the stroke cycle are the drive and the recovery. During the drive the blade 15 is placed vertically in the water, and it is pulled through the water in this position. At the end of the drive, the blade 15 is extracted form the water, and the oar 1 is rotated by 90 degrees so that its blade 15 is parallel to the water surface. This rotation is called feathering, and the blade 15 is said to be feathered when it is parallel to the water surface. As shown in FIG. 1, arrow 6 shows the direction in which the oar 1 is rotated when it is being feathered. The blade 15 remains feathered through most of the recovery, a position that is shown in FIG. 4. During the recovery, the blade of the oar is moved above the water surface toward the bow of the boat. As the end of the recovery is approached the oar is rotated by 90-degrees so that the blade 15 becomes orthogonal to the water surface again. This rotation is called squaring, and the blade 15 is said to be square when it is orthogonal to the water surface. At the end of the recovery, the blade 15 is inserted in the water, and the stroke cycle begins again with a drive.

The digital indicating device 30 detects the squaring and feathering of the oar 1. The time interval between two consecutive feathers is measured, and it is used to calculate the stroke rating. Other parts of the stroke can also be used to calculate the stroke rating.

Figure 5:
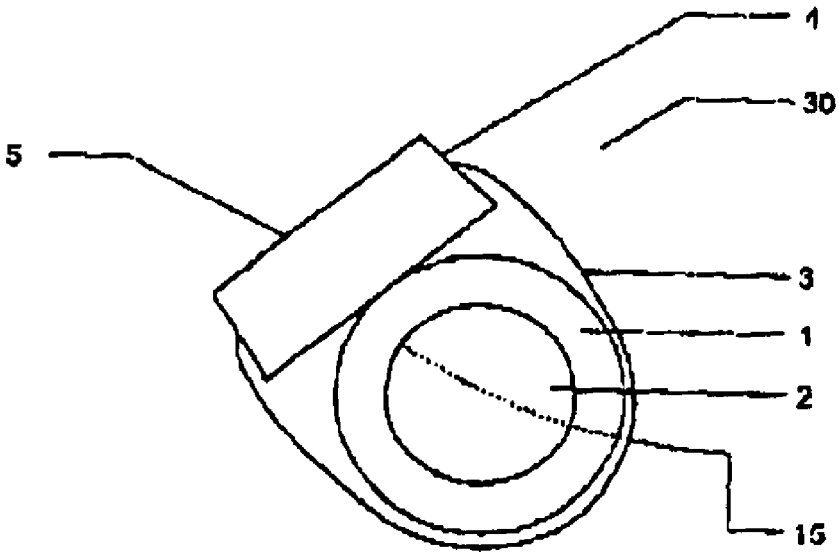
FIG. 5 shows the device mounted to the oar, looking down the shaft of the oar toward the blade.

FIG. 1, FIG. 4 and FIG. 5 show an embodiment of the device 30 mounted to an oar 1 close to the grip 2. An enclosure 4 houses a display 5, a sensor 7, a microcontroller 8, a power source 9 and a clock 10. In the preferred embodiment, the clock is a component of the microcontroller. The stroke rating is displayed on display 5. A strap 3 is attached to enclosure 4. Strap 3 fastens enclosure 4 to the oar 1. The direction of the rotation of the oar 1 from the squared position to the feathered position is shown by arrow 6. In the preferred embodiment, enclosure 4 is a waterproof plastic case 5 similar in size to a wristwatch. Much like a wristwatch it can be fastened to an oar 1 with a strap 3. Because of its small size, it does not hinder rowing while remaining in plain view of the rower. Because of the simple fastening mechanism the device 30 can be easily installed and removed from rowing equipment.

Figure 2:
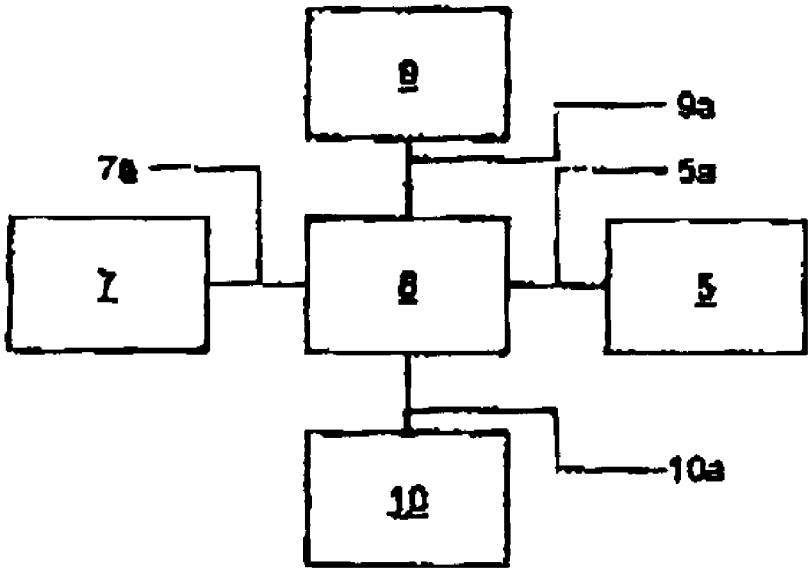
FIG. 2 shows the block diagram of the major electronic components of the device.

FIG. 2 shows a block diagram of the major electronic components of the device 30. A microcontroller 8 is the central electronic component. In the preferred embodiment, microcontroller 8 is a low-power, 8-bit microcontroller, with an integrated liquid crystal display driver. A sensor 7 for detecting squaring and feathering of the oar sends signals to microcontroller 8 via line 7*a*. In the preferred embodiment, sensor 7 is a tilt switch.

An accelerometer can also be used as sensor 7. A clock 10 sends uniform timing signals to microcontroller 8 via line 10*a*. In the preferred embodiment, clock 8 is a quartz crystal and is integrated in the microcontroller 8. A timer in microcontroller 8 uses these signals to keep track of the time. Microcontroller 8 sends signals for displaying the stroke rating to a display unit 5 via line 5*a*. In the preferred embodiment, display unit 5 is a two digit seven segment liquid crystal display. A power source 9 is connected to microcontroller 8 via line 9*a*. In the preferred embodiment, power source 9 is a small 3V lithium cell battery.

Operation

Figure 3:
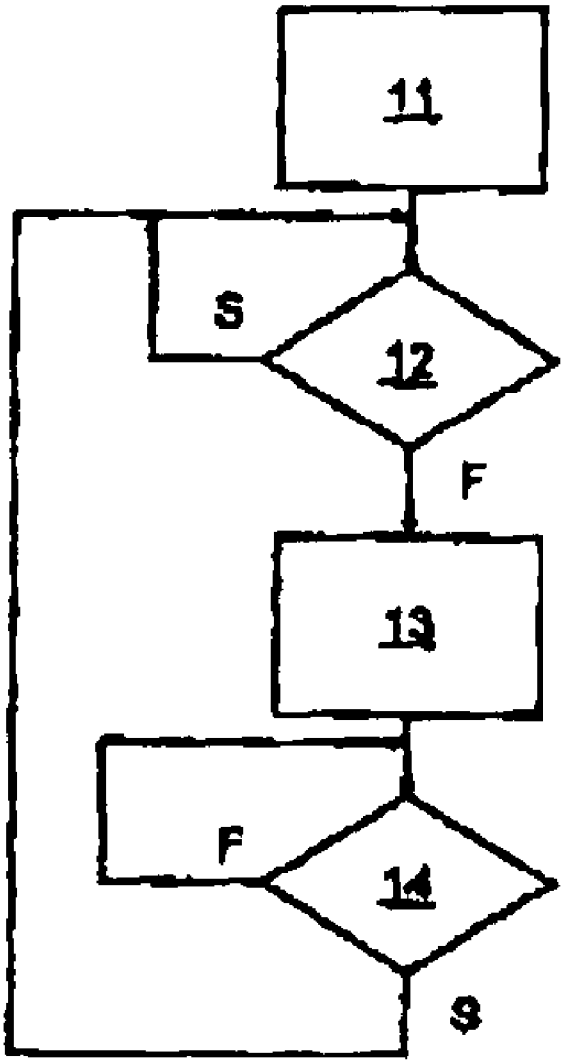
FIG. 3 shows the flowchart of the operation of the device.

FIG. 3 shows a flowchart of the operation of the invention. In state 11 an internal variable, t (subscript 0), and the microcontroller timer, t, are set to zero. Execution in state 12 waits until the oar 1 is feathered. The left branch of state 12 is followed if the signal from sensor 7 indicates that the oar 1 is squared. In the preferred embodiment the sensor is a tilt switch which is open (not grounded) when the oar is in the feathered position. Analyzing the signal to identify a characteristic indicative of the oar being feathered is done by waiting for the signal to stabilize in the open state. The bottom branch for 12 is followed if the signal from sensor 7 indicates that the oar 1 is feathered. In state 13 the stroke rating is calculated, it is displayed, and the internal variable, t (subscript 0), is updated. The time elapsed between two consecutive feathers is used to calculate the stroke rating using the following formula.

$$60/t-t(\text{subscript } 0)=S$$

In this formula, t is the current time as indicated by the timer, t(subscript 0) is the time at which the previous feather occurred, and S is the stroke rating measured in strokes per minute. The stroke rating, S is then displayed on display 5. After this, the internal timer variable, t (subscript 0), is set to the current time, t. Execution in state 14 waits until the oar is squared again. In the preferred embodiment the sensor is a tilt switch which is closed (grounded) when the oar is in the squared position. Analyzing the signal to identify a characteristic indicative of the oar 1 being feathered is done by waiting for the signal to stabilize in the closed state. The left branch of state 14 is followed if the signal from sensor 7 indicates that the oar is squared.

Other parts of the stroke cycle can also be detected using this device. Placing the oar 1 in the water at the end of the recovery phase is a quick motion which results in some vibration of the oar 1. Because of this vibration the tilt switch used in the preferred embodiment generates a short signal which can be analyzed to detect this phase of the stroke. More complex analysis of the stroke cycle can be realized when an accelerometer is used as the sensor.

In the preferred embodiment as shown in FIG. 4, the device 30 is attached to the oar 1 so that its display 5 is facing the rower when the oar 1 is feathered and in the "hands away" position. As shown in FIG. 5, the display 5 of the device 30 should be at a 45 degree angle to the blade of the oar. It should be mounted as close as possible to the grip of the oar 1.

While rowing, it will be easiest to read the display 5 of the device 30 when the rower is in the "hands away" position during recovery. In this position the rower can simply drop their gaze slightly to the device 30 to read the display 5. FIG. 4 shows the positions of the oars when they are feathered and in the "hands away" position.

In the preferred embodiment, the device 30 goes to sleep after 30 seconds of being idle. The device 30 wakes up it detects movements. It's estimated the batteries can keep the unit running for over a year, so the device 30 has the capability to be carried around in a bag or pocket for a long period of time.

The device 30 uses an easy to use attachment means such as a strap 3 for easy attachment to the oar 1. This allows the device to be easily attached and detached to the oar 1. Using an easy to use attachment means such as the strap 3 allows the user to have a stroke rate monitor installed on every boat they might row in. This allows the device 30 the great advantage of being easy to install and to use. The device 30 is also small and compact enough to being easily carried and stored by the user.

Advantages The previously described version of the present invention has many advantages, including many elements missing in all prior art. It provides a digital indicating device that does not hinder rowing while remaining in plain view of the rower, easy to use and easy to carry. The device can also be easily installed and removed from the rowing equipment, so it can be used on various rowing-type devices.

Although many features, functions, and advantages of the present invention have been described in this specification, together with details of the structure of specific embodiments thereof, the description as a whole is illustrative only, and substitutions may be made in detail, especially in matters of shape, dimension and arrangement of elements within the principles of the invention to the full extent indicated by the broad, general meaning of the terms in which the claims are expressed. Therefore, the point and scope of the appended claims should not be limited to the description of the preferred versions contained herein.

I claim:

1. A device for measuring the stroke rating in rowing comprising: a compact device that can be placed on the oar, a sensor means mounted to said oar to generate a signal in response to rotation of the oar about its long axis at least one controller coupled to said sensor means to receive signal therefrom, at least one controller being configured to analyze the signal to identify a characteristic in the signal indicative of the oar being rotated so that its blade is parallel to the water surface, to identify a second characteristic in the signal indicative of the oar being rotated so that its blade is orthogonal to the water, to identify a third characteristic in the signal indicative of the oar being rotated so that its blade is parallel to the water again, and to determine an elapsed time period between when the first and third characteristics appeared in the signal.

2. The device of claim 1 whereby said Sensor means is a tilt switch.

3. The device of claim 1 whereby the at least one controller being further configured to calculate the stroke taken per minute from the elapsed time.

4. The device of claim 1 Wherein said controller is a microprocessor.

5. The device of claim 1 wherein said device has a power supply connected to a plurality of controllers and said sensor means.

6. The device of claim 1 wherein said device has a display means connected to at least one controller.

7. The device of claim 1 wherein said device has a display means consisting of a liquid crystal display connected to at least one controller.

8. The device of claim 1 wherein said device has an attaching means attaching said device to the oar.

9. The device of claim 1 wherein said device has an attaching means consisting of a strap attaching said device to the oar.

10. The device of claim 1 wherein said device has said controller and said sensor within an enclosure.

11. The device of claim 1 wherein said device has said controller and said sensor within an enclosure where said enclosure is waterproof.

12. A method for measuring the stroke rating in rowing comprising steps of: having a compact device that can be placed on the oar, mounting a sensor to said oar, using said sensor to generate a signal In response to the rotation of the oar about its long axis, analyzing the signal to identify a first characteristic in the signal indicative of the oar being rotated so that its blade is parallel to the water surface, analyzing the signal to identify a second characteristic in the signal indicative of the oar being rotated so that its blade is orthogonal to the water surface, analyzing the signal to identify a third characteristic in the signal indicative of the oar being rotated so that its blade is parallel to the water surface, determining an elapsed time period between when the first and third characteristics appeared in the signal.

13. The method of claim 12 further comprising of calculating the strokes taken in a minute from the elapsed time.

14. The method of claim 13 where the feathering and squaring parts of the stroke cycle are being detected.

* * * * *